US007497488B2

(12) United States Patent
Chen

(10) Patent No.: US 7,497,488 B2
(45) Date of Patent: Mar. 3, 2009

(54) ROTARY LATCH

(75) Inventor: John Chen, Foothill Ranch, CA (US)

(73) Assignee: Ryadon, Inc, Foothill Ranch, CA (US)

( * ) Notice: Subject to any disclaimer, the term of this patent is extended or adjusted under 35 U.S.C. 154(b) by 304 days.

(21) Appl. No.: 11/364,016

(22) Filed: Feb. 28, 2006

(65) Prior Publication Data

US 2007/0200358 A1 Aug. 30, 2007

(51) Int. Cl.
*E05C 3/12* (2006.01)

(52) U.S. Cl. ..... 292/216; 292/DIG. 30; 292/DIG. 31

(58) Field of Classification Search ..... 292/216, 292/DIG. 30 X, DIG. 31 X, DIG. 37, 217, 292/210, 240; 70/208, 209, 224, 221
See application file for complete search history.

(56) References Cited

U.S. PATENT DOCUMENTS 3,371,511 A 3/1968 Atkinson
3,782,141 A 1/1974 Doerrfeld
4,438,964 A 3/1984 Peters
4,911,487 A 3/1990 Rachocki
4,951,486 A 8/1990 Braun et al.
4,989,907 A 2/1991 Edmonds et al.
5,042,853 A 8/1991 Gleason et al.
5,069,491 A 12/1991 Weinerman et al.
5,127,686 A 7/1992 Gleason et al.
5,299,844 A 4/1994 Gleason
5,439,260 A 8/1995 Weinerman et al.
5,450,734 A 9/1995 Esaki et al.
5,526,660 A 6/1996 Bennett et al.
5,564,295 A * 10/1996 Weinerman et al. ..... 70/208
5,586,458 A 12/1996 Weinerman et al.
5,595,076 A 1/1997 Weinerman et al.
5,611,224 A * 3/1997 Weinerman et al. ..... 70/208
5,884,948 A 3/1999 Weinerman et al.

(Continued)

*Primary Examiner*—Jennifer H. Gay
*Assistant Examiner*—Mark Williams
(74) *Attorney, Agent, or Firm*—Fulwider Patton LLP; Gary M. Anderson

(57) ABSTRACT

A rotary latch having a pivoting handle mounted in the recess of a mounting plate includes a turn-key member that rotates within the handle's free end, and the turn-key member is mechanically linked to a catch rod where rotation of the turn-key member results in a corresponding rotation of the catch rod. As a result of the rotation of the turn-key member, the catch rod has two positions—a "lock" position that does not engage a swiveling trip lever, and an "unlocked" position that engages the swiveling trip lever. When the turn-key member rotates the catch rod into the unlocked position, an actuation/pivoting of the handle about the pivot pin rotates the free end of the handle away from the mounting plate recess to linearly displace the catch rod. The linear displacement of the catch rod causes it to come into contact with and pivot the arm of a swiveling trip lever. The trip lever arm, when rotated by the catch rod, rotates an adjacent kicker journaled on the mounting plate's rear surface. The kicker includes a kicker pin that is engaged by the swiveling trip lever, causing the release kicker to rotate and push a guard rotary. The guard rotary protects a capture rotary from opening, where the capture rotary retains a lock bar. However, when the release kicker pushes the guard rotary against the bias of a dedicated spring, the capture rotary can rotate freely and open outward to release the captured lock bar.

4 Claims, 5 Drawing Sheets

U.S. PATENT DOCUMENTS 5,941,104 A * 8/1999 Sadler ..... 70/208
5,984,383 A 11/1999 Parikh et al.
6,039,363 A 3/2000 Sugimura et al.
6,109,670 A 8/2000 Tomaszewski et al.
6,247,732 B1 6/2001 Alton
6,264,254 B1 7/2001 Siegfried et al.
6,651,467 B1 * 11/2003 Weinerman et al. ..... 70/208
6,953,209 B2 * 10/2005 Jackson et al. ..... 292/66
6,973,810 B2 * 12/2005 Chen ..... 70/208
7,097,216 B2 * 8/2006 Lane et al. ..... 292/216

* cited by examiner

ROTARY LATCH

BACKGROUND OF THE INVENTION

The present invention is directed generally to mechanical latching mechanisms, and more particularly to a rotary latch for a door (such as a vehicle door) or container that captures and releases a traverse (i.e., vertical) latching member to regulate access to a space such as a vehicle compartment door or a heavy storage box, or other latch release application. The release of the bar is accomplished by actuating a pivoting handle mounted on the housing, wherein the handle includes a turn-key member to lock and unlock the latch device.

DESCRIPTION OF THE RELATED ART

Rotary latches are used in many applications such as vehicle doors, chests, cabinets, and the like where a lid or door needs to be held or locked in a closed position. Rotary latches are preferred in some applications because they can be designed to spring open upon latch release and may be slammed shut to a closed or locked position.

Rotary latches can be found in many existing applications. U.S. Pat. No. 6,502,871 to Malmanger issued Jan. 7, 2003 entitled "Rotary Latch System and Method" discloses a rotary latch for opening and closing a panel or door. U.S. Pat. No. 6,454,321 to Parikh issued Sep. 24, 2002 entitled "Rotary latch Operated By a T-Handle With Multiple Latch Actuator Connection Points" discloses a rotary latch with a T-handle that translates rotation to an actuating lever for triggering a trip pawl to release a latch jaw. U.S. Pat. No. 5,884,948 to Weinerman et al. issued Mar. 23, 1999 entitled "Rotary Latch and Lock" discloses another type of rotary latch. However, each of the latch mechanisms described in the references above are have various shortcomings in terms of simplicity, reliability, and cost-effectiveness. Further, in many paddle latch systems the locking feature manifests itself in the prevention of the handle being able to travel. This can be defeated by extreme force. Thus, the art is in need of a paddle type latch system that allows the handle to travel in a full range of motion even in the locked configuration, where the travel of the handle is simply ineffective to release the latch in the locked position.

SUMMARY OF THE INVENTION

The present invention is a rotary latch having a pivoting handle mounted in the recess of a mounting plate. A handle return spring preferably biases the handle into the plate's recess. The handle includes a key actuated lock that rotates within the handle's free end, and the lock is mechanically linked to a catch rod behind the mounting plate where rotation of the lock results in a corresponding rotation of the catch rod. The catch rod has two positions—a "locked" position corresponding to an angular orientation that precludes engagement with a swiveling trip lever, and an "unlocked" position that engages the swiveling trip lever. When the lock rotates the catch rod into the unlocked position, then an actuation/pivoting of the handle about a pivot pin rotates the free end of the handle away from the mounting plate recess to linearly displace the catch rod. The linear displacement of the catch rod causes it to come into contact with and pivot the arm of the swiveling trip lever. The trip lever arm, when rotated by the catch rod, in turn drives an adjacent kicker journaled on the mounting plate's rear surface. The kicker, when driven by the swiveling trip lever, pushes a guard rotary out of contact with a capture rotary. When in contact, the guard rotary protects the capture rotary from opening and releasing a latch bar. However, when the kicker pushes the guard rotary away from the capture rotary against the bias of a dedicated spring, the capture rotary can rotate freely and open outward to release the captured vertical latch bar.

Other features and advantages of the invention will become apparent from the following detailed description, taken in conjunction with the accompanying drawings which illustrate, by way of example, the features of the invention

DETAILED DESCRIPTION OF THE PREFERRED EMBODIMENTS

Figure 1:
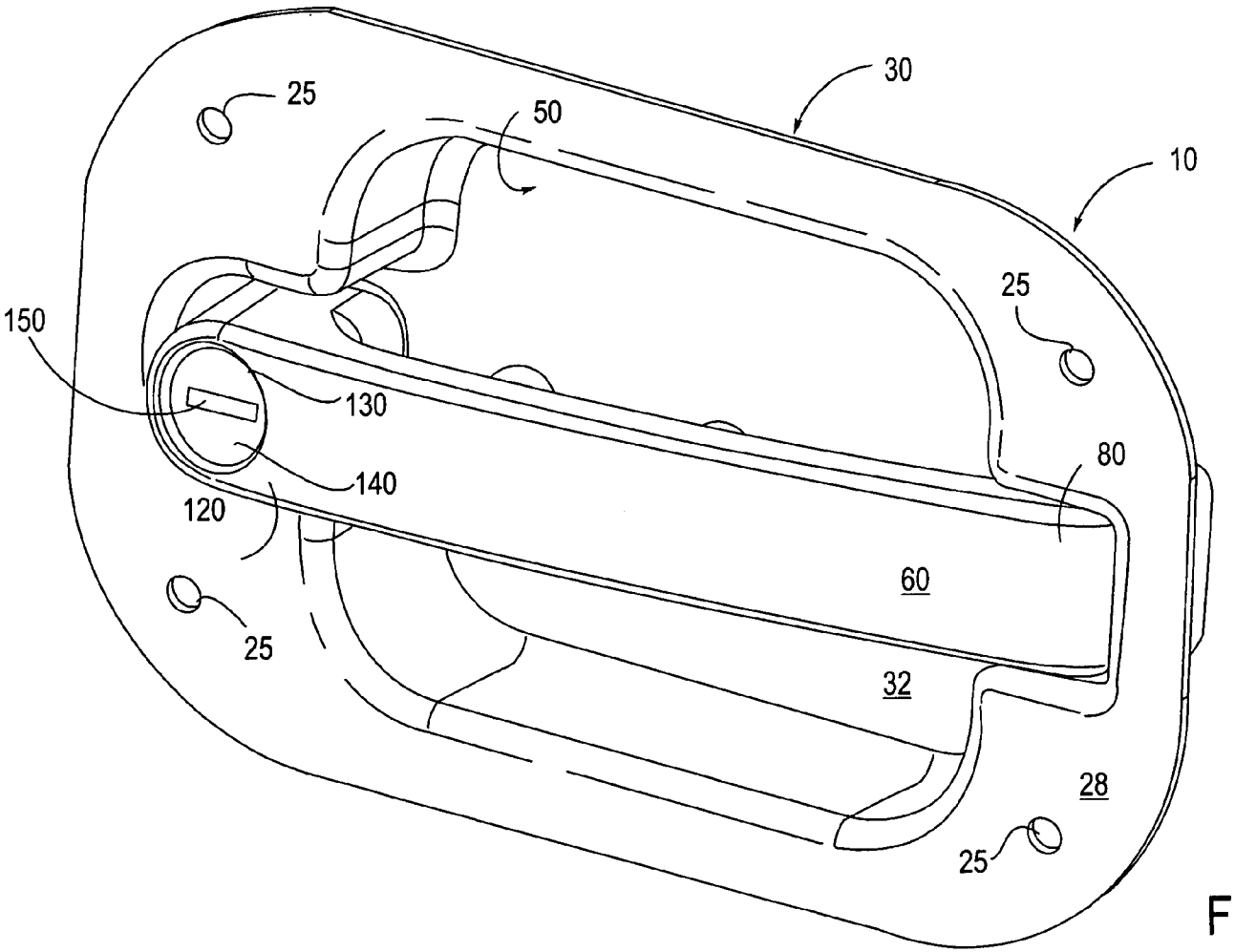
FIG. 1 is an elevated perspective view from the front of a rotary latch assembly of the present invention.

FIG. 1 illustrates a first preferred embodiment of the rotary latch assembly 10 of the present invention. A handle assembly is mounted to a face plate 30 within a recessed cavity 50 formed into the face plate 30 to accommodate a pivoting handle 60. A plurality of holes 25 are spaced along the face plate 30 for attaching the rotary latch assembly 10 to its recipient apparatus, such as a vehicle door or cabinet. The face plate 30 has a generally planar front surface 28 that recedes to a rear wall 32 to form the cavity 50. The cavity 50 is shaped to fit the ends of the handle 60 with a slight clearance at each end, and expands around the central portion of the handle 60 to permit grasping the handle from above or below with one's fingers. The handle 60 is pivotally mounted at a base end 80 using a pivot pin 90 mounted through the face plate 30. A return spring (not shown) is preferably incorporated into the pivot pin/face plate mounting arrangement as is known in the art to bias the handle 60 to the position shown in FIG. 1.

Grasping the handle 60 about the central portion, a user can overcome the force of the return spring and pivot the movable end 120 of the handle 60 away from the cavity 30 until a stop plate 40 (FIG. 2) contacts the back of the face plate 30 from behind the face plate, stopping the movement of the handle 60. Releasing the handle 60 allows the return spring to return the handle 60 back into the face plate 30 as reflected in FIGS. 1 and 2.

The free end 120 of the handle 60 opposite the base end 80 includes an annular portion 130 surrounding a cylindrical turn-key member 140. The turn-key member 140 includes a keyhole 150 and requires a key (not shown) to rotate the turn-key member 140 within the free end 120 of the handle 60. Rotation of the key creates two positions for the turn-key member—an unlocked position and a locked position.

Figure 2:
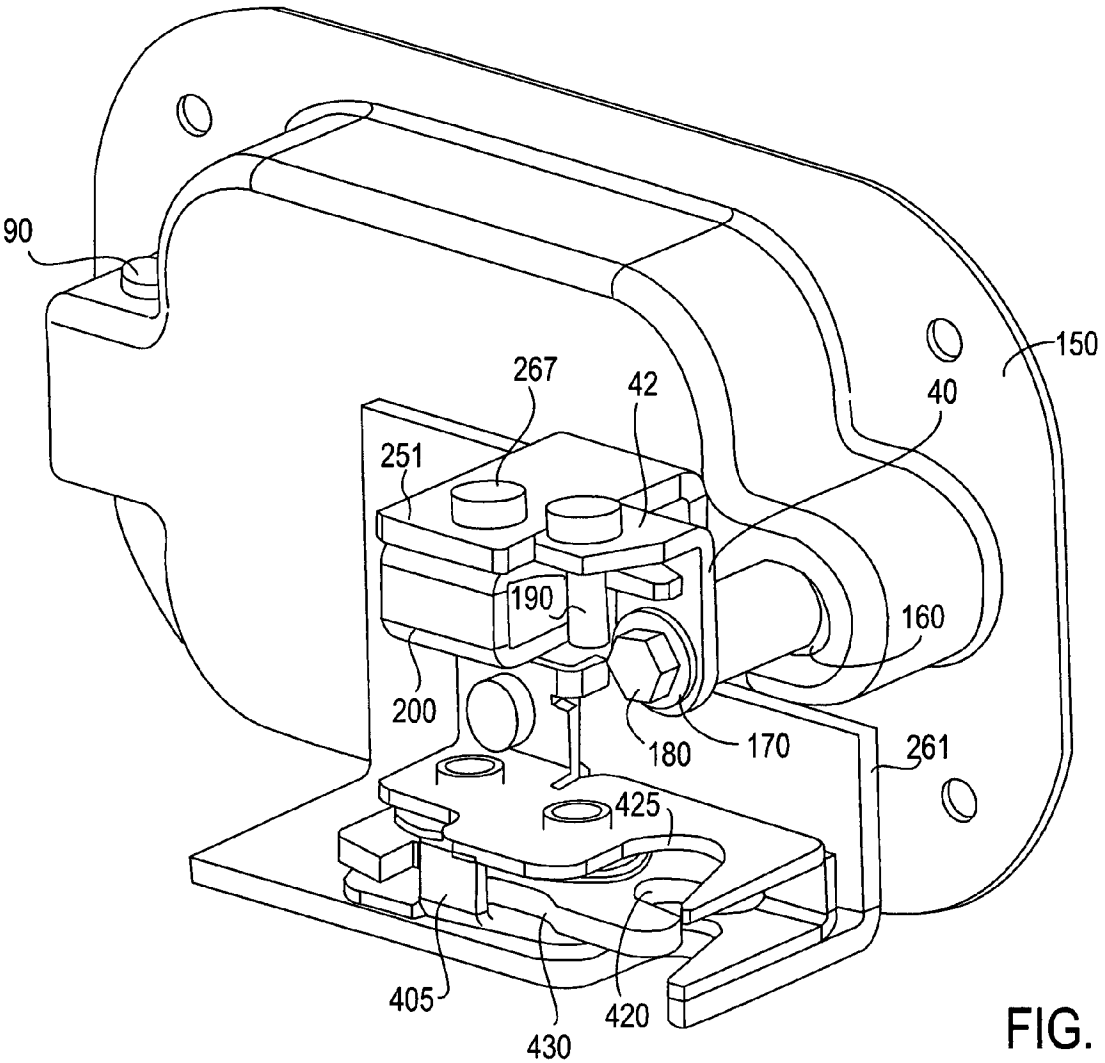
FIG. 2 is a perspective rear view of the latch of FIG. 1.
Figure 3:
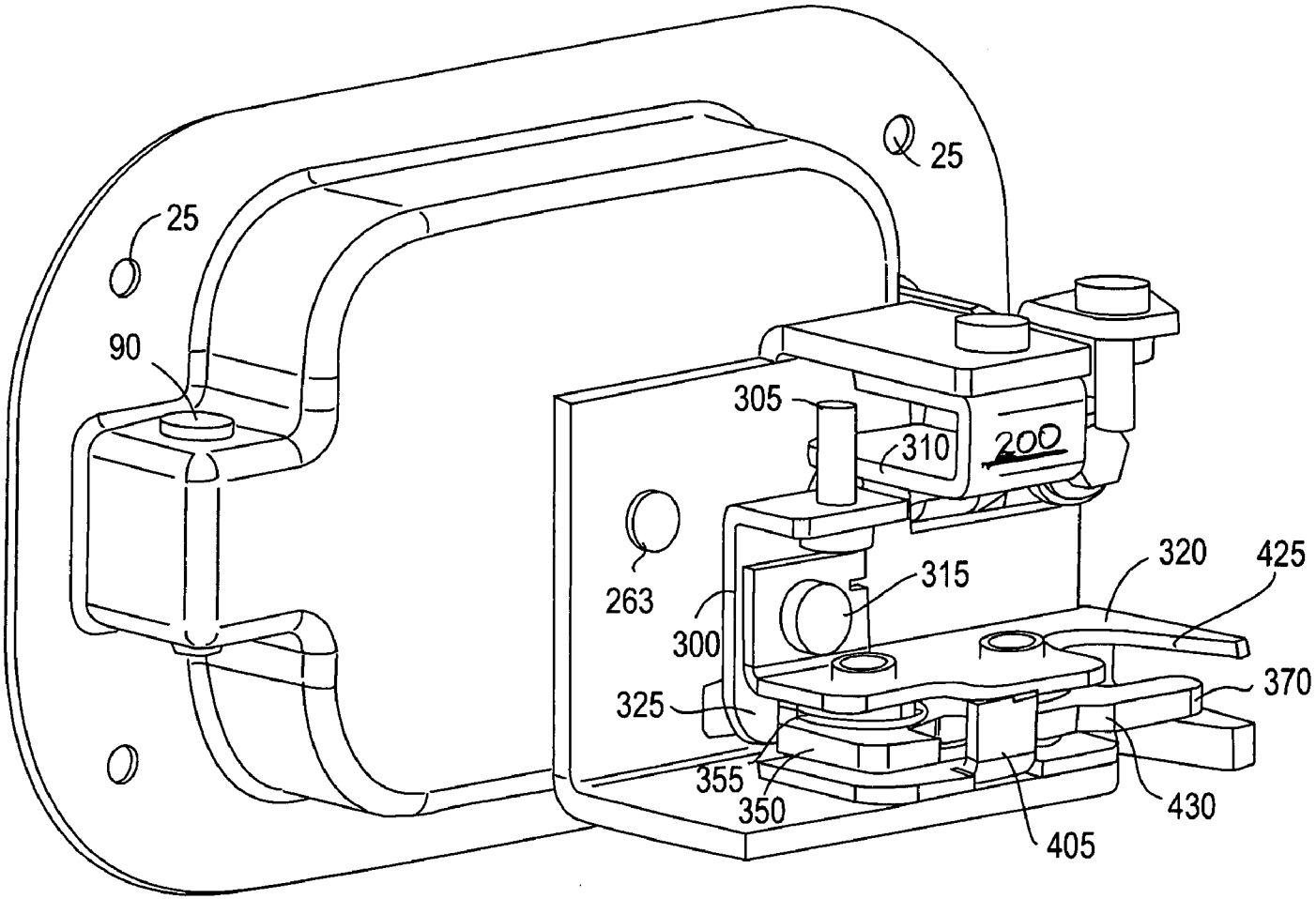
FIG. 3 is a second perspective rear view of the latch of FIG. 1.
Figure 4:
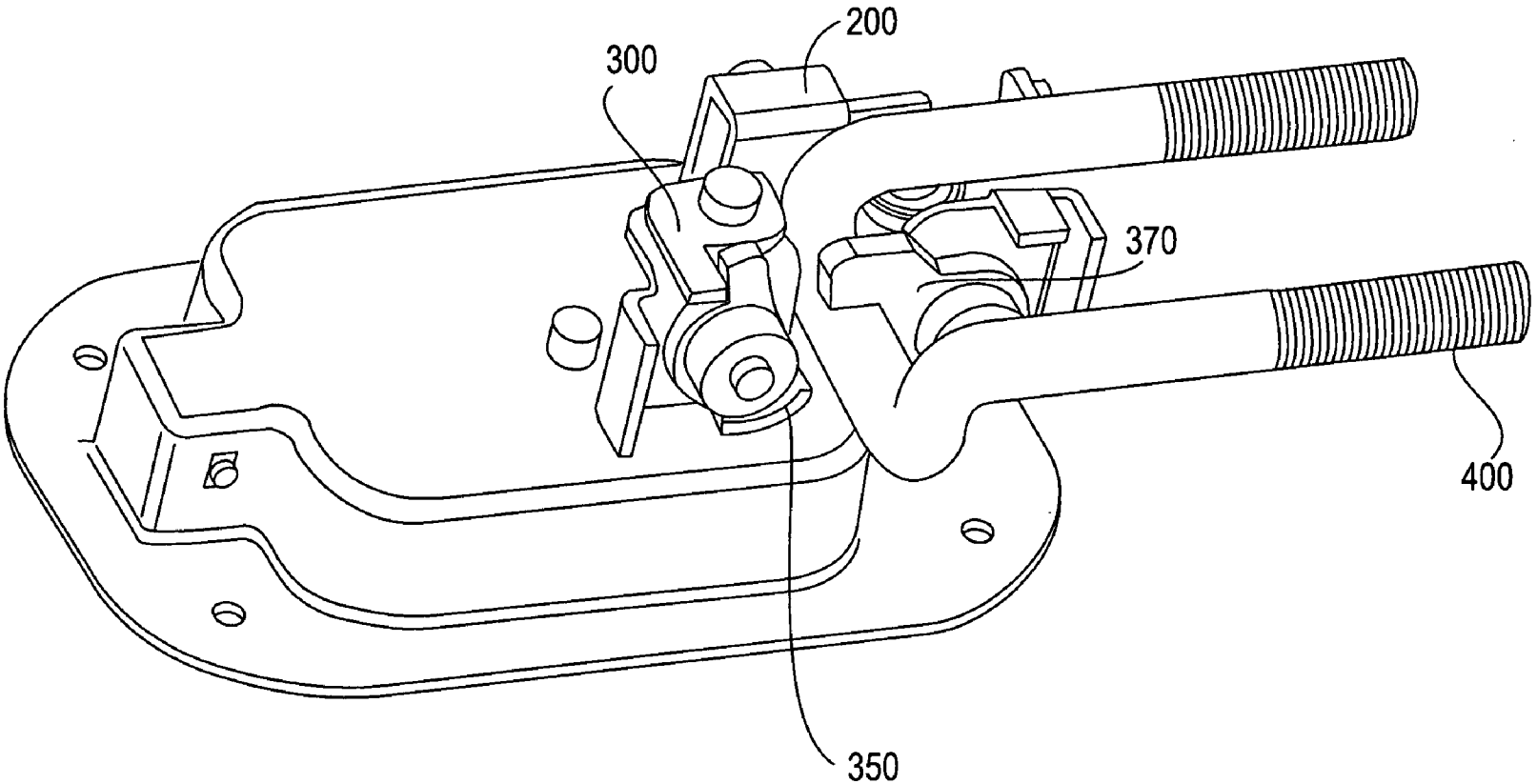
FIG. 4 is a rear perspective view of the latch and catch rod combination of FIG. 1 with the brackets removed.
Figure 5:
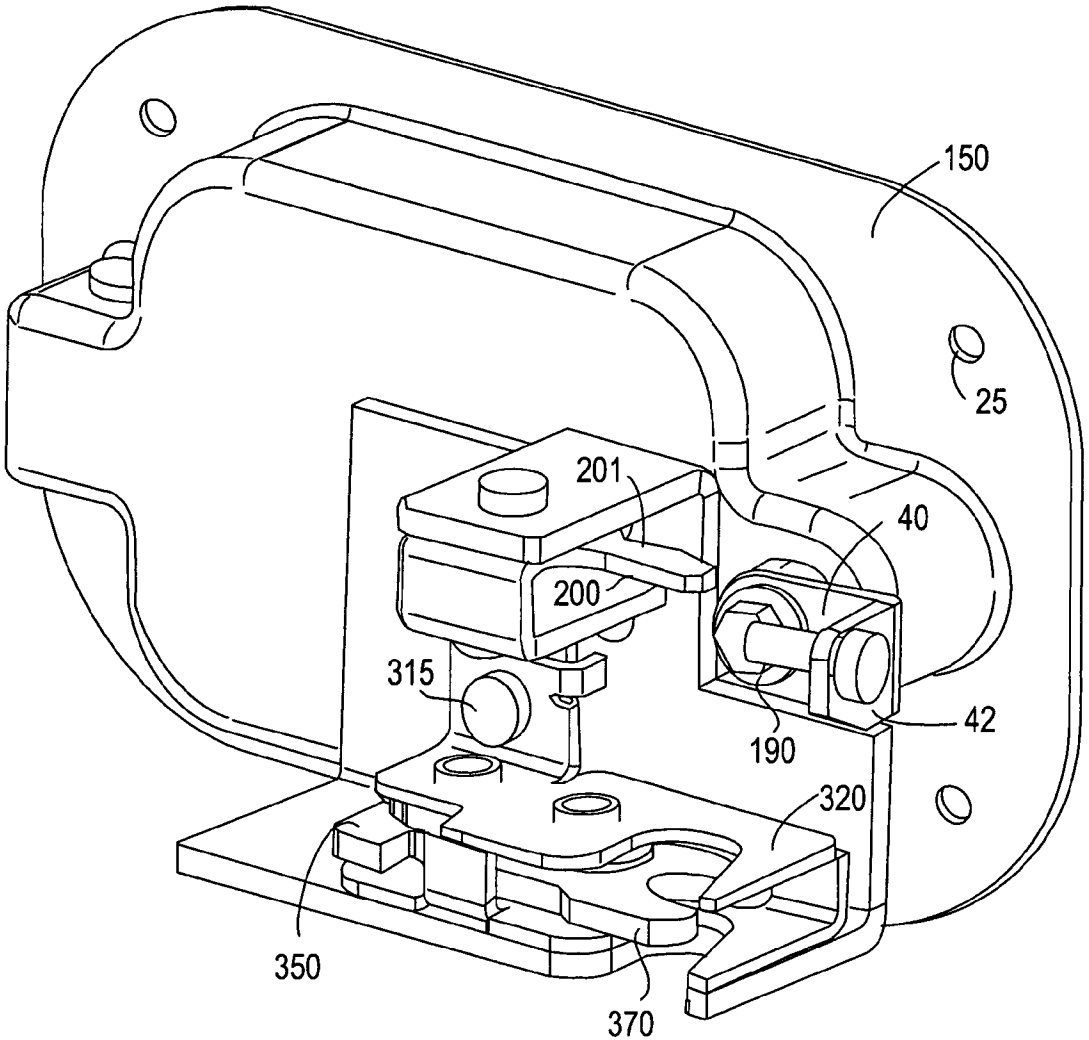
FIG. 5 is a perspective rear view of the latch of FIG. 1 in the locked position.

FIGS. 2-5 illustrate the cooperation of the handle 60 and the turn-key member 140 to set in motion components that open the latching mechanism described more fully below. Behind the rear wall 150 of the face plate 30, the cylindrical turn-key member 140 extends rearwardly through an aperture 160 in the cavity 50. Secured to the end of the turn-key member 140 by a washer 170 and bolt 180 is a stop plate 40 that limits the extent the handle 60 can be extended out of the face plate 30. Here, the width or height of the stop plate 40 is larger than the diameter of the aperture 160. The stop plate 40 has a perpendicular member 42 that supports a catch rod 190. In FIG. 2, the catch rod 190 is shown in a vertical position corresponding to an unlocked position of the turn key member 140. In FIG. 5, the catch rod 190 is shown in a horizontal position corresponding to a locked position. Rotation of the turn-key member 140 via the associated key rotates the catch rod 190 between the locked and unlocked positions. In other words, by rotating the key within the keyhole 150 of the turn-key member 140, the mechanical linkage of the catch rod 190 and turn-key member 140 causes the catch rod 190 to assume either the unlocked or locked positions as shown in FIGS. 2 and 5, respectively.

As the handle 60 is pivoted away from the cavity 50 of the face plate 30, the turn-key member 140 is pulled through the cavity 50 of the face plate 30, and catch rod 190 is translated toward the back 150 of the face plate 30 as shown in FIG. 5. The motion of the handle 60 is created by the grasping of the handle 60 about the middle portion and pulling the handle against the biasing force of the return spring until the stop plate 40 comes in contact with the back wall 150 of the face plate 30, terminating the displacement of the handle 60. Releasing the handle 60 causes the return spring to withdraw the handle back to its original position and returns the catch rod 190 to its original position spaced from the rear wall 150. Two situations arise depending upon the position of the turn-key member 140. If the turn-key member 140 is rotated such that the catch rod 190 takes the locked position shown in FIG. 5, an actuation of the handle 60 fails to engage a rotating or swiveling trip lever 200 because the catch rod 190 is horizontal and its path does not interfere with the position of the trip lever 200. In this position, a user can pull the handle 60 but cannot actuate the latching mechanism, highlighting the importance of the key position in the operation of the device. It is noted that while locked, the handle still moves through its full range of motion, and yet no amount of force can cause the catch rod 190 to engage the swiveling trip lever 200.

If the turn-key member 140 is rotated such that the catch rod 190 is in the unlocked position as shown in FIG. 2, then actuation of the handle 60 and the resulting displacement of the catch rod 190 causes the catch rod 190 to come into contact with a protruding arm 201 of the swiveling trip lever 200. As the handle 60 is pulled out of the cavity 50, the force imparted by the catch rod 190 on the arm 201 of the trip lever 200 causes the trip lever 200 to rotate counterclockwise when viewed from above (see FIG. 2). The trip lever 200 is mounted to a horizontal projection 251 of a support bracket 261, which itself is mounted to the rear surface 150 of the face plate 30 by fastener 263. The trip lever 200 is configured for rotation about a trip lever pin 267 mounted through the horizontal projection 251 of the support bracket 261. Thus, the displacement of the arm 201 of the trip lever 200 by the force of the catch rod 190 is translated into a rotation of the trip lever 200 about its pin 267.

As best seen in FIG. 3, the swiveling trip lever 200 rotates in the horizontal direction and is adjacent a kicker 300 that rotates in a horizontal direction. The kicker 300 includes a vertically disposed kicker extension pin 305 that lies directly in the path of the swiveling trip lever 200, such that when the swiveling trip lever is engaged by the catch rod 190 and rotates counterclockwise, the opposing face 310 of the trip lever 200 engages the kicker extension pin 305 and forces the kicker 300 to rotate in a vertical plane about the rotary bracket mounting pin 315. The rotary bracket mounting pin 315 secures the rotary bracket 320 as well as permits rotation of the kicker 300 in its vertical plane.

Rotation of the kicker 300 about the rotary bracket mounting pin 315 causes the toe 325 of the kicker 300 to contact and rotate a guard rotary 350 against the force of a guard rotary spring 355. As shown in FIG. 4 with the brackets removed, the guard rotary 350 and capture rotary 370 cooperate to trap a lock bar 400 in the latch 10. The lock bar 400 may be mounted to a car door frame or a cabinet lid such that the latch serves to secure the door of a car (which the latch is mounted onto) or the lid of a cabinet to the mating frame. If the guard rotary 350 is rotated out of engagement with the capture rotary 370 by the kicker 300, the capture rotary 370 may rotate freely and thereby release the lock bar 400. In this manner, the rotary latch can be used to free the lock bar 400 only when the turn key member 140 is rotated into the unlocked position. Otherwise, extension of the handle 60 does not engage the latch mechanism and no release of the lock bar 400 is possible no matter the force applied to the handle. The capture rotary is preferably biased open to receive the lock bar 400 by a bias spring (not shown) which causes the capture rotary 370 at edge 430 to bear against the capture rotary stop 405, leaving the U-shaped opening 420 of the capture lever facing away from inlet 425 formed in the rotary bracket 320. In this position, the lock bar 400 can enter the inlet 425 and be received by the capture rotary 370 in the U-shaped opening 420, whereupon further force will cause the capture rotary 370 to rotate until it bears against the guard rotary 350 (see FIG. 4) and become registered in that position until the guard rotary 350 is rotated out of engagement by the kicker 300.

The description of the preferred embodiments are illustrative only and should not be construed as limiting the scope of the invention. One of ordinary skill in the art can deviate from the just-described embodiments without departing from the spirit of the invention. For example, while a pivoting handle is preferred, another handle that pulls out from the housing at each end is also possible. The cooperation of the catch rod with the turn-key member can take many forms and utilize additional mechanical linkages to alter the direction of the applied force and the direction of the translation and rotation of the various components, while still preserving the essence of the present invention. Thus, the scope of the present invention should not be limited by the descriptions above, but rather the scope of the invention is defined solely by the words of the claims presented below.

I claim:

1. A rotary latch comprising:

a handle pivotally mounted to a mounting plate and mechanically linked to a catch rod by reciprocating member extending through the mounting plate, said catch rod extending traversely to a longitudinal axis of said reciprocating member;

a turn key member within said handle, said turn key member rotating within said handle to define a locked position of said catch rod and an unlocked position of said catch rod;

a swiveling trip lever secured to the mounting plate for rotation in a first plane about a pin and actuated by said catch rod when said turn key member establishes said catch rod in the unlocked position but not when said turn key establishes said catch rod in the locked position;

a kicker rotatable in a plane perpendicular to said first plane, said kicker actuated by the swiveling trip lever to disengage a guard rotary;

said guard rotary and capture rotary rotating in a plane parallel to said first plane and cooperating to retain a lock bar in said latch in a first position, and release said lock bar from said latch in a second position initiated by engagement of said kicker with said guard rotary.

2. The rotary latch of claim 1 wherein said mounting plate includes a recessed cavity at a central portion, said handle mounted at a first end in the cavity for pivoting movement therein.

3. The rotary latch of claim 2 wherein said pivoting movement of said handle linearly displaces the catch rod.

4. A toolbox latch comprising:

a face plate with a recessed cavity at a central portion thereof, the recessed cavity including an aperture;

a handle in said recessed cavity mounted at a first end on a traversely extending pivot pin, said handle biased into the recessed cavity of the face plate by a return spring member disposed about said pivot pin, said handle further comprising a head portion at a second end including a rotateable turn-key element concentrically mounted in the handle head and protruding rearwardly from the handle head through the aperture in the face place recessed cavity, a catch rod mounted distally to the handle head on said turn-key element, the catch rod rotating with the turn-key element between a first radial position parallel to said handle corresponding to a locked position and a second radial position perpendicular to said handle corresponding to an unlocked position;

a swiveling trip lever configured to swivel in a plane perpendicular to the face plate, the swiveling trip lever comprising a protruding arm operably disposed adjacent the catch rod when said catch rod is in the second radial position corresponding to the unlocked position;

a kicker disposed adjacent the swiveling trip lever including an extension pin vertically extending therefrom, the extension pin positioned in the path of the swiveling trip lever such that engagement of the swiveling trip lever with the extension pin causes a toe of the kicker to rotate about a kicker pivot pin;

a guard rotary mounted for rotation in a plane perpendicular to a plane of rotation of said kicker and including an opposing surface adjacent said toe of said kicker for engagement therewith such that rotation of the kicker causes the toe to engage and rotate said guard rotary from a detained position to a release position; and a capture rotary cooperating with said guard rotary to retain a lock bar therein when said guard rotary is in said detained position, and to release said lock bar therein when said guard rotary is in said release position.

* * * * *